US005135076A

United States Patent [19]

Su

[11] Patent Number: 5,135,076

[45] Date of Patent: Aug. 4, 1992

[54] ESCAPE SLIDEWAY

[76] Inventor: Ching Y. Su, Kaohsiung, Taiwan

[21] Appl. No.: 675,177

[22] Filed: Mar. 26, 1991

[51] Int. Cl.[5] ..... A62B 1/20

[52] U.S. Cl. ..... 182/48; 182/68

[58] Field of Search ..... 182/48, 64, 65, 66, 182/67, 62.5, 63, 49, 68; 14/24, 37

[56] References Cited

U.S. PATENT DOCUMENTS 2,376,875 5/1945 Honig ..... 182/66
2,556,175 6/1951 Frost ..... 14/37 X
2,614,743 10/1952 Arps ..... 182/66
3,385,398 5/1968 Garnett ..... 182/67 X
4,602,697 7/1986 Aanensen ..... 182/48

*Primary Examiner*—Alvin C. Chin-Shue
*Attorney, Agent, or Firm*—Fleit, Jacobson, Cohn, Price, Holman & Stern

[57] ABSTRACT

An escape slideway comprises a base stand, a swivel table, slidway faces, handrails, connecting plates, an oil hydraulic motor, a wiring wheel, wire ropes, etc.. By loosing or winding wire ropes, the slideway can be exended or folded. The escape slideway can be extended to the top of next tall building, a safe place, or earth for persons 10 escaping in an emergency.

8 Claims, 12 Drawing Sheets

ESCAPE SLIDEWAY

BACKGROUND OF THE INVENTION

This invention relates to escape slideways for houses and buildings, and more particularly to such escape slideways that are positionable into various positions and are extendable.

The conventional escape slideways for application to houses or apartment buildings are too short to be used for tall buildings. They are designed and adapted for balconies and railings when they are not used as escape means.

BRIEF SUMMARY OF THE INVENTION

It is an object of this invention to provide an escape slideway for houses and buildings.

It is a further object of this invention to provide an escape slideway for houses and buildings which is extendable and can be used for tall buildings.

It is a further object of the invention to provide an escape slideway which when required to be used in the event of a fire can be extended to an adjacent tall building, a safe place, or to the ground to allow persons to escape in the emergency.

The above objects are achieved by this invention which provides an escape slideway having a base stand with a fixed gear thereon and a main shaft through the fixed gear engaged with a swivel table. A driving gear driven by oil hydraulic motor is engaged with the swivel table so that the swivel table pivots above the base stand upon the main shaft. The swivel table has an oil tank mounted thereon and control equipment so that the oil hydraulically drives power equipment to rotate a reel mounted on the swivel table which has fixed thereto one end of a pair of wire ropes. The other ends of the wire ropes are fixed to the slideway. By winding or unwinding the wire ropes, the slideway can be raised or lowered. When the slideway is extended, its terminal can reach the ground or the top of an adjacent building to provide an escape route for persons in an emergency. The slideway is comprised of articulated sections which are folded or extended to vary the length of the slideway.

BRIEF DESCRIPTION OF THE DRAWINGS

This invention will now be described in detail with reference to the accompanying drawings wherein.

DETAILED DESCRIPTION

Figure 4:
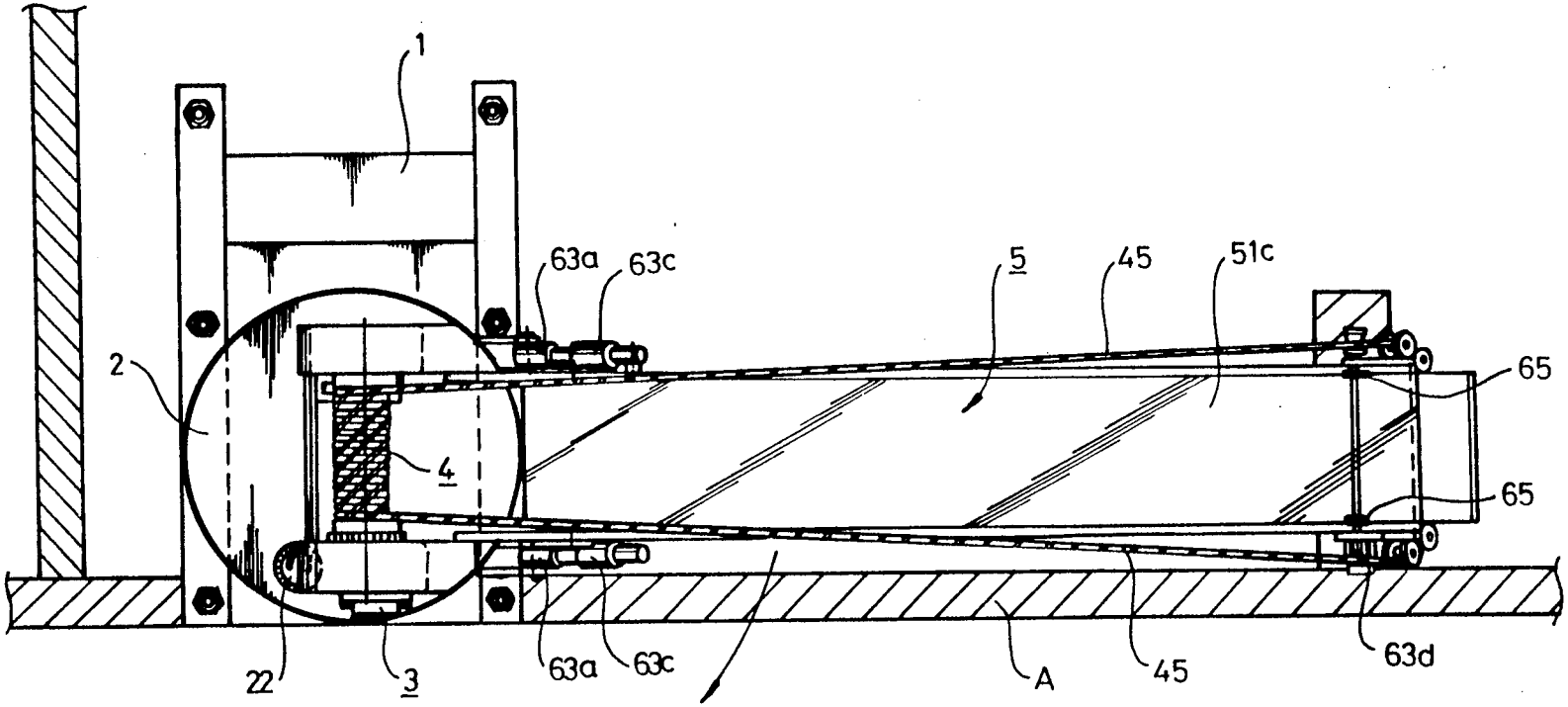
FIG. 4 is a top plan view of the escape slideway assembly in accordance with this invention.
Figure 5:
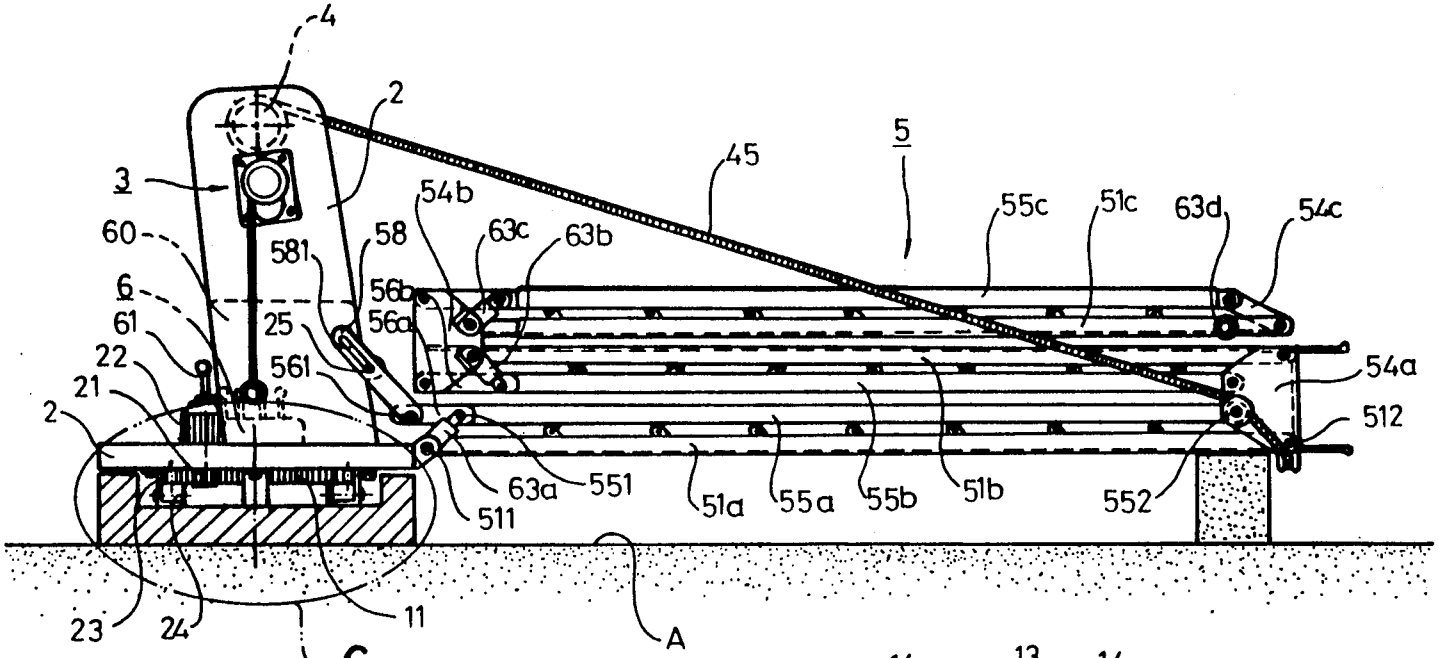
FIG. 5 is a side elevational view of the escape slideway assembly in accordance with this invention.
Figure 7:
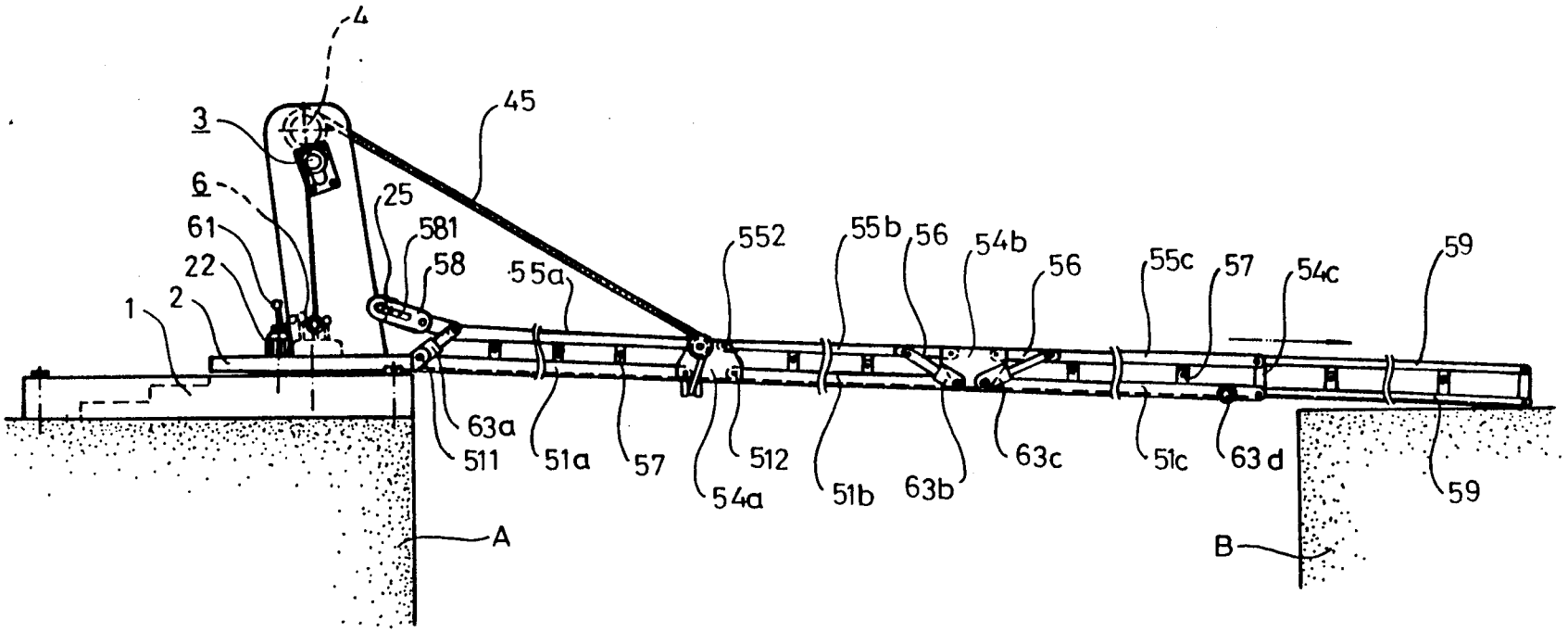
FIG. 7 is a side elevational view showing a practical example of use of this invention.
Figure 8:
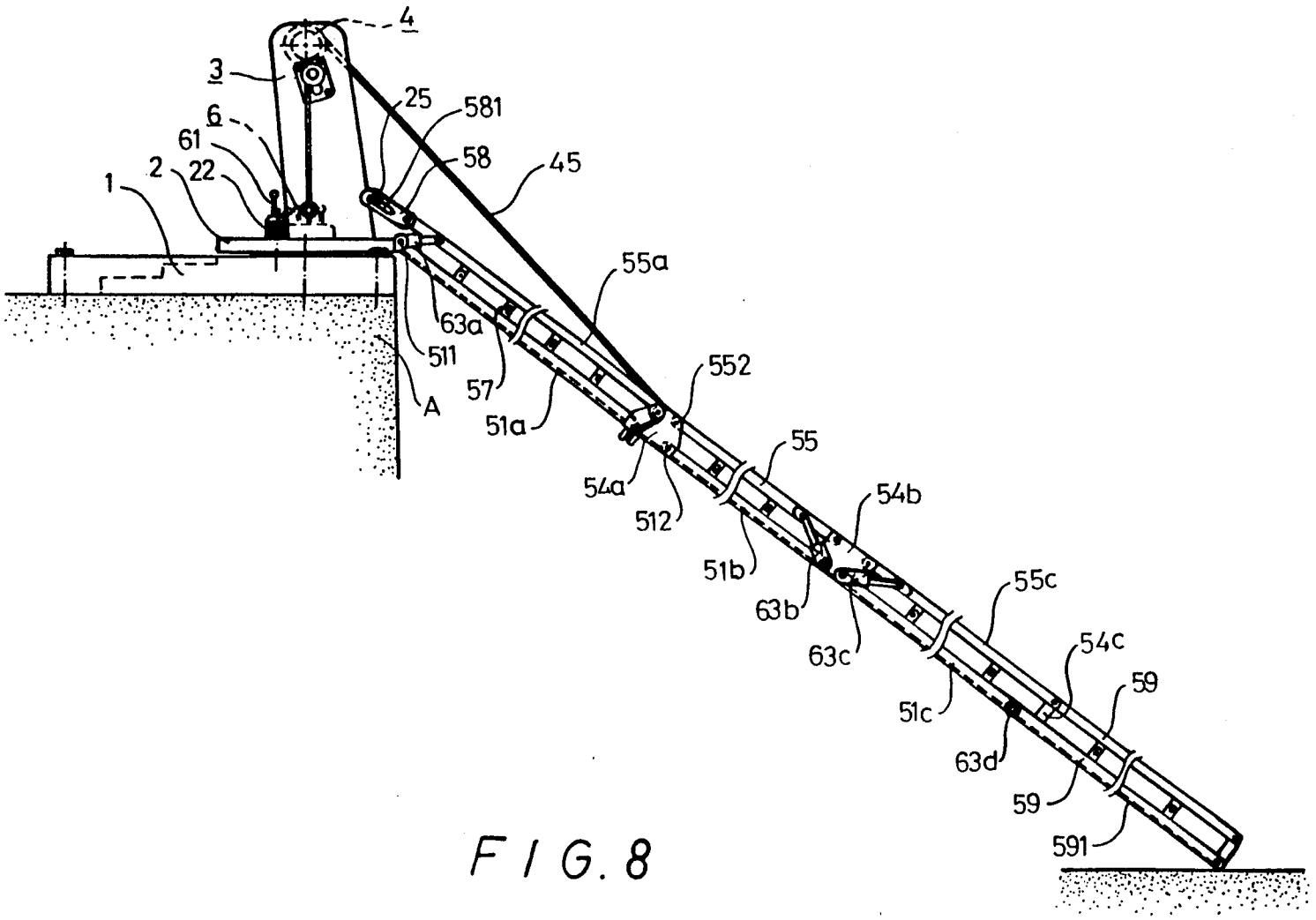
FIG. 8 is a view similar to FIG. 7 showing another practical example of use of this invention.

Referring to FIG. 4, lifesaving equipment of the invention is installed at the top floor's fence, edge, or railing A on a tall building and parallel longitudinally with the railing or edge A so that the equipment will occupy a minimum of space. Referring to FIG. 5, the equipment is fixed at railing or edge A by a base stand 1 and is higher than railing or edge A so that the slideway 5 can be swiveled partially to the outside thereof as shown in FIGS. 7 and 8. The slideway 5 can be extended to the roof B of an adjacent tall building to form an overhead escape bridge, or extended to the ground or other safe place to form an escape slideway.

Figure 6:
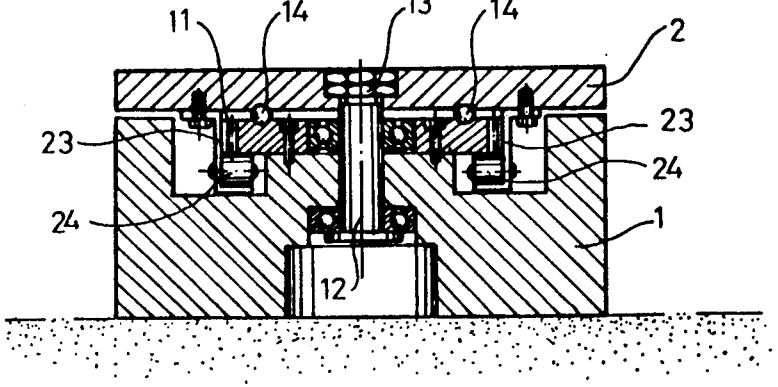
FIG. 6 is an enlarged cross-sectional view of the encircled part 6 in FIG. 5.

Referring to FIGS. 1, 2, 5 and 6 the base stand 1 has a fixed ring gear 11 mounted thereon such as by screws or bolts 67. A main shaft 12 is fastened at its upper end to a swivel table 2 by a nut 13 and is rotatably mounted in base stand 1 and in ring gear 11 by bearings 66. The swivel table 2 has a gear 21 rotatably mounted thereon and engaging with the gear 11 on base stand 1. Gear 21 is rotatably driven by oil hydraulic motor 22 mounted on swivel table 2 so that the swivel table 2 will rotate above the base stand 1. The gear 11 has steel balls or bearings 14 between its upper surface and the lower surface of table 2 for smooth rotation of table 2. The bottom of swivel table 2 has supports 23 mounted thereon to support rollers 24 which engage the bottom of gear 11 as shown in FIG. 6 so that the swivel table 2 rotates smoothly above base stand 1 without the problem of overturning. The slideway 5 mounted to and above the swivel table 2 is rotated therewith.

The swivel table 2 has an oil tank 60 to supply hydraulic fluid to hydraulic equipment 6 driving power equipment 3 to rotate a winding reel or winch 4. By winding and unwinding wire ropes or cables 45 on reel 4, the slideway is raised and lowered and can be extended or folded as shown in FIGS. 7, 8. When the slideway 5 is extended, its outer terminal end can reach a safe place or ground for allowing persons to escape the building.

Figure 1:
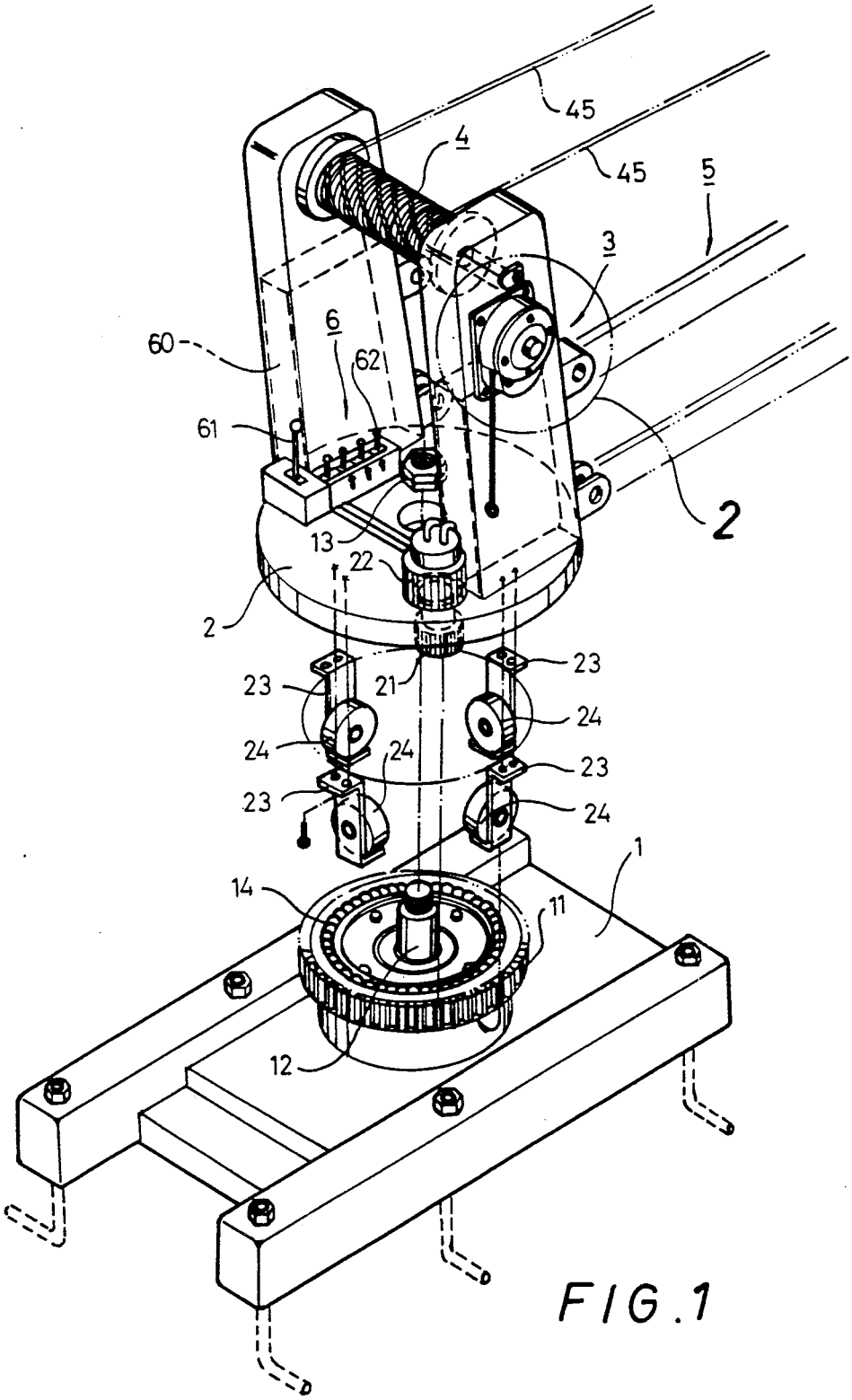
FIG. 1 is a perspective exploded view of a base stand, swivel table and wire reel assembly for the escape slideway in accordance with this invention.
Figure 3:
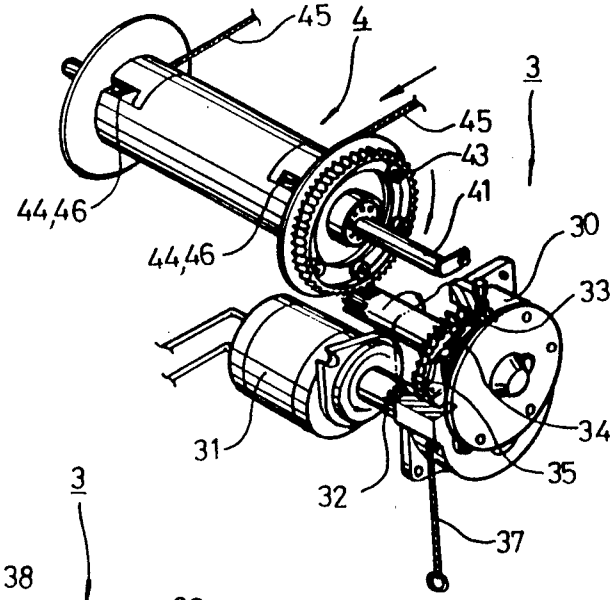
FIG. 3 is a perspective view of the transmission assembly of FIG. 2.
Figure 2:
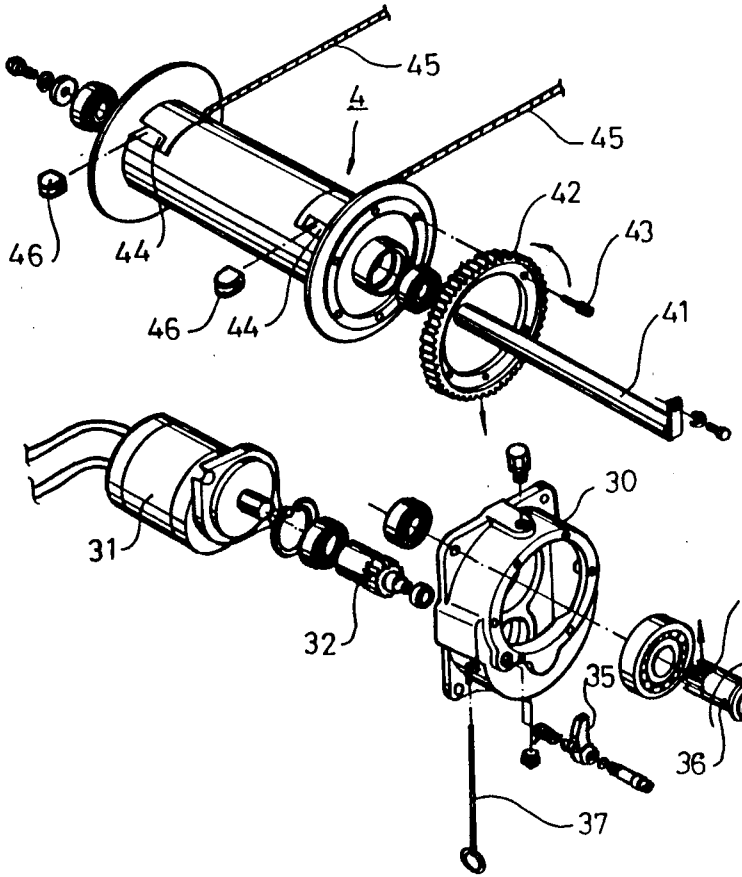
FIG. 2 is an exploded perspective view of the transmission wire reel on the base stand in accordance with this invention.

Referring to FIGS. 2, 3 power equipment 3 comprises a gear casing 30 and an oil hydraulic motor 31 or a wobble pump mounted on casing 30. The output shaft of oil hydraulic motor 31 has a driving gear 32 thereon engaged with a transmission gear 33 on shaft 36. The shaft 36 of gear 33 has a one-way rotating ratchet 34 thereon controlled by a claw 35. The claw 35 is pulled by a recoil rope 37 to pivot and release claw 35 from the teeth of rachet 34 so that the shaft 36 will not be constrained against rotating. The teeth 38 of shaft 36 drive reel 4 when shaft 36 rotates by engaging ring gear 42 ground shaft 41. Gear 42 is engaged with reel 4 by bolts 43 so that reel 4 can be driven by oil hydraulic motor 31. Reel 4 has open slots 44 to provide for one end of each wire rope 45 to pass therethrough. The ends of wire ropes 45 are clamped by heads 46 so that the wire ropes 45 remain connected at their ends to reel 4. The wire ropes 45 can be wound or unwound by rotating reel 4.

The other end of each wire rope 45 is attached to the slideway 5. When the wire ropes 45 are unwound, the slideway 5 is lowered and can be extended to form a long slideway which may be inclined at an angle as shown in FIGS. 7, 8. When the wire ropes 45 are wound, the slideway 5 is raised and can be folded to a shorter length.

Referring to FIGS. 5, 7 and 8, the slideway embodiment shown has three sections. The number of sections can be increased according to the practical application by adding connecting elements similar to plates 54*a*, 54*b* to connect adjacent ends of each slideway section formed by elongated planks or plate-like members 51*a*, 51*b*, 51*c*, having slideway faces. Oil hydraulic cylinder-piston units 63*a*, 63*b*, 63*c* are pivotally connected at suitable places as shown to the slideway sections and handrails 55*a*, 55*b*, and 55*c*. The oil hydraulic cylinder-piston units have hydraulic lines (not shown) to join them with an oil tank and suitable valves designed to produce the control function thereof.

Figure 10:
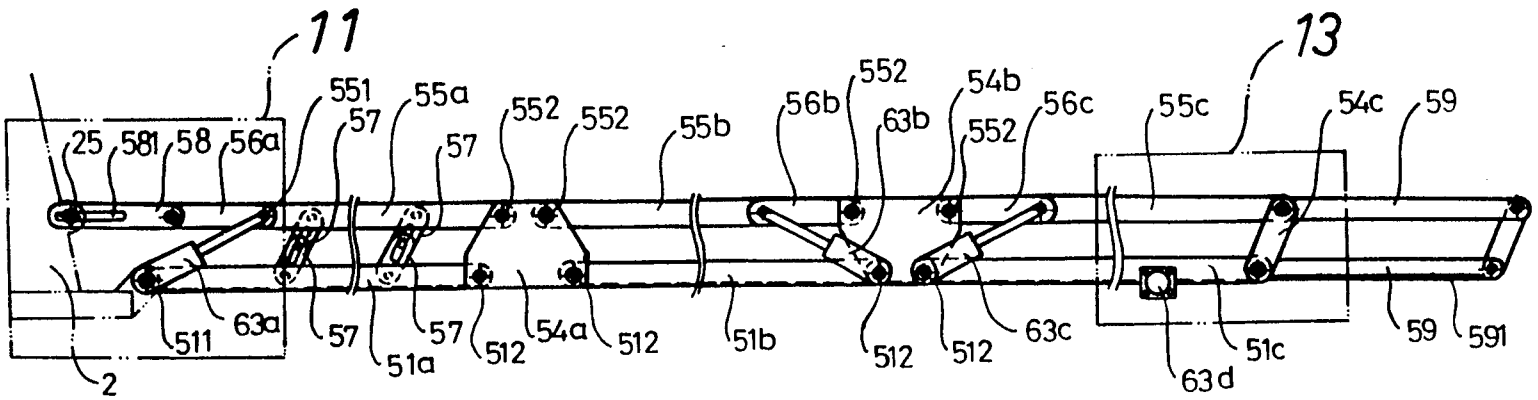
FIG. 10 is a view similar to FIG. 9 of the slideway in an extended position.
Figure 14:
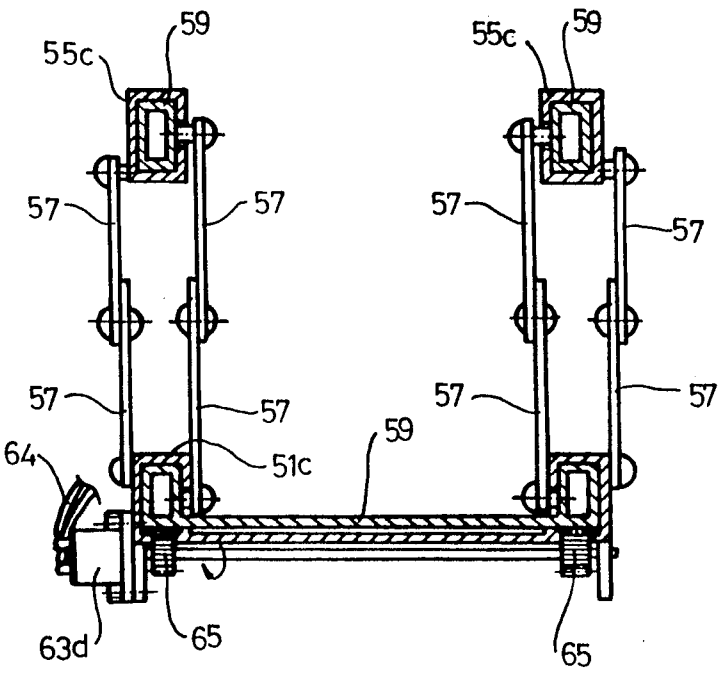
FIG. 14 is a cross-sectional view taken along line 14—14 of FIG. 13.
Figure 13:
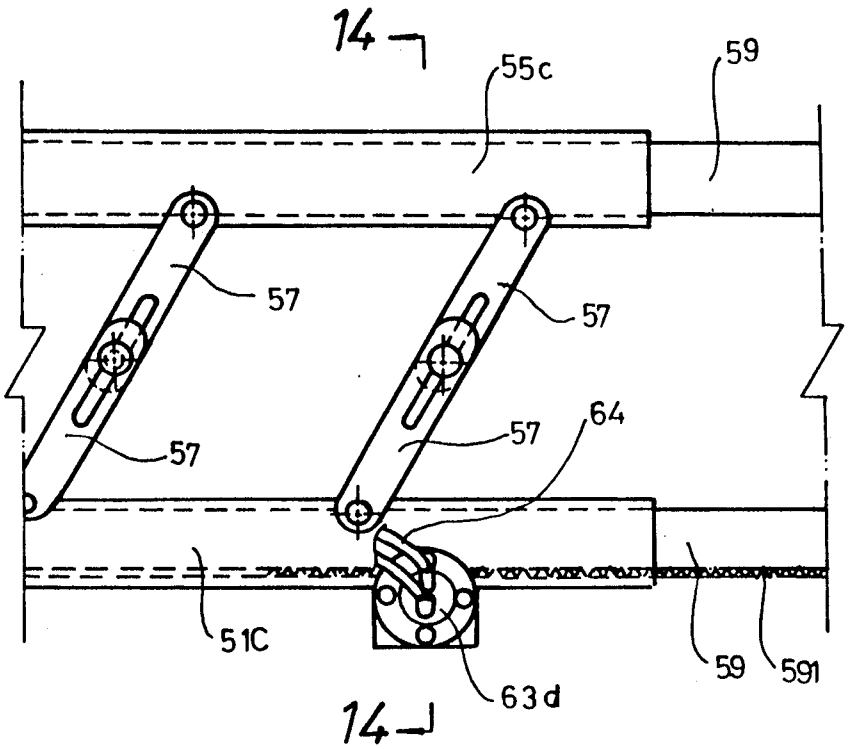
FIG. 13 is an enlarged detail view of encircled part 13 in FIG. 10.

Referring to FIGS. 5 and 10, the slideway sections 51 are numbered from lowest to highest, i.e. a first slideway section 51*a*, a second slideway section 51*b*, and a third slideway section 51*c*. One end of first slideway section 51*a* is pivotally connected at 511 to swivel table 2. The other end of first slideway section 51*a* is pivotally connected at 512 to a first connecting plate 54*a*. A first handrail 55*a* is connected between first slideway face 51*a* and first connecting plate 54*a*. One end of first handrail 55*a* is pivotally connected at 551 to a connecting board 56*a* and the expansion arm's, or piston-rod, end of oil hydraulic cylinder-piston unit 63*a*. The other end of first handrail 55*a* is pivotally connected at 552 to first connecting plate 54*a*. There are a number of connecting links 57 between first handrail 55*a* and first slideway section 51*a* as best shown in FIGS. 13 and 14. Each connecting link 57 comprises a pair of link members whose outer ends are connected pivotally to first handrail 55*a* and first slideway section 51*a*. One link member of each pair uses a pin inserted in a long slot of the other to adjustably connect each pair together.

Connecting board 56*a* which pivotally joins with first handrail 55*a* is pivotally connected at 551 to a board 58 member having a long slot 581 therein. Board 58 uses long slot 581 to receive therein a pin 25 an swivel table 2. Hence, first handrail 55*a* can be extended along with first connecting plate 54*a* so that first connecting plate 54*a* pivots on the pivot 512 of first slideway section 51*a* when the oil hydraulic cylinder-piston unit 63*a* extends.

Referring to FIG. 10, second slideway section 51*b* and second handrail 55*b* are pivotally connected to and between first connecting plate 54*a* and second connecting plate 54*b*. The second handrail 55*b* is pivotally connected to connecting board 56 and at the expansion or piston rod arm's end of oil hydraulic cylinder-piston unit 63*b*. The other end of each of board 56*b* and the cylinder-piston unit 63*b* is pivotally connected to second connecting plate 54*b*. A hydraulic line connect the hydraulic units 63*a* and 63*b* to a control valve 61 and an oil tank so that the operation of the oil hydraulic cylinder-piston units 63*a* and 63*b* can be controlled.

Figure 9:
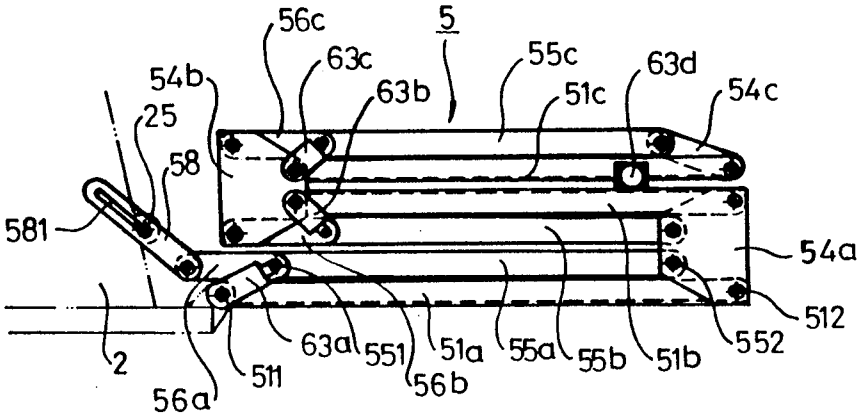
FIG. 9 is a side elevational view of the escape slideway in accordance with this invention in a stored or folded condition.

When the oil hydraulic cylinder-piston units extend, first and second handrails 55*a* and 55*b* and second slideway section 51*b* pivot at first connecting plate 54*a* to change from the piston of FIG. 9 to that of FIG. 10. Similarly, third handrail 55*c* and third slideway section 51*c* are pivotally connected with a terminal 54*c* and second connecting plate 54*b*. When the oil hydraulic cylinder-piston unit 63*c* extends, third handrail 55*c* and slideway section 51*c* are extended equally so that all slideway sections 51 can be extended linearly as shown in FIG. 10. Then the slideway section 51 can be extended between two tall buildings to form an overhead escape bridge as shown in FIG. 7, or to form a staircase extending to earth as shown in FIG. 8.

For increasing the length of the slideway, an inner tube 59 is inserted into the terminal of third slideway section 51*c* and third handrail 55*c* so that the inner tube 59 can extend inside the third slideway section 51*c*. The bottom of inner tube 59 has a rack 591 (see FIG. 13). The third slideway section 51*c* has an oil hydraulic motor 63*d* (see FIG. 14) which is connected to hydraulic line 64 to drive a gear 65. The gear 65 is engaged with the rack 591 at the bottom of inner tube 59. Hence, when oil hydraulic motor 63*d* rotates, the inner tube 59 can be extended or shrunk so that the length of the slideway can be adjusted. For the protection of persons using the escape apparatus, the connecting links 57 are installed between the elongated inner tube 59 and handrail 55*c*.

Figure 11:
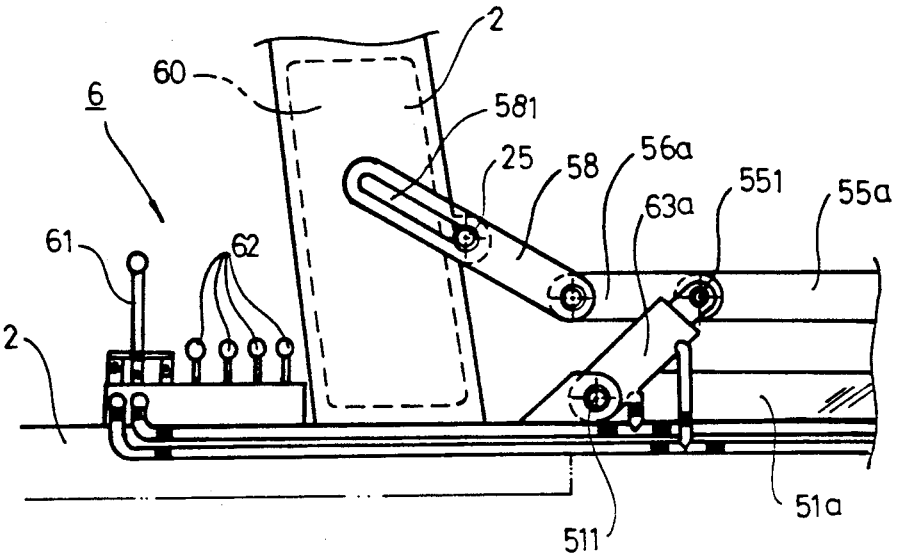
FIG. 11 is an enlarged detail view of encircled part 11 in FIG. 10 showing a folded position.
Figure 12:
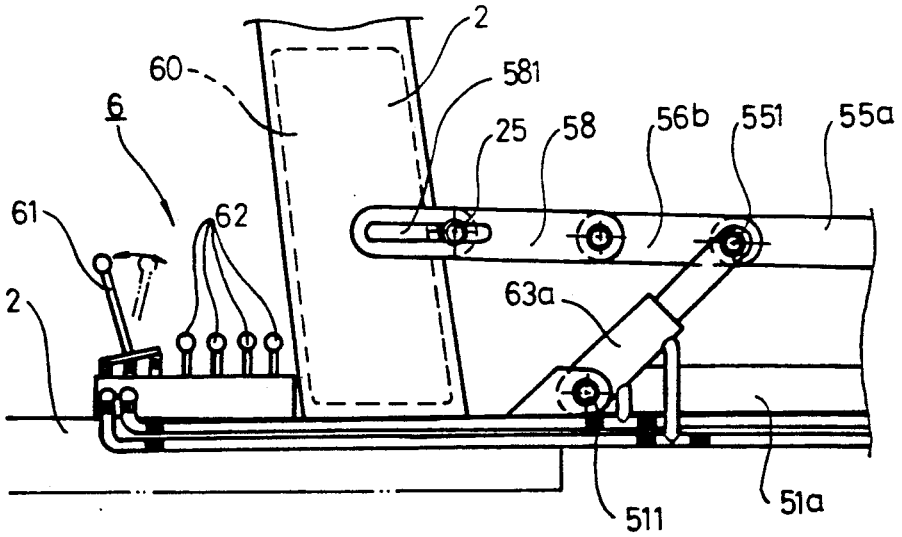
FIG. 12 is a view similar to FIG. 11 showing an extended position.

Referring to FIGS. 11 and 12, hydraulic equipment 6 has a rocker or pump arm 61 to generate pump action and to drive oil through the control valve having control levers 62. When the escape equipment is not used, the control levers 62 are fixed at a preset position so that the oil will flow back to the oil tank 60 of hydraulic equipment 6. By manipulating control levers 62 to change the route of oil so that it flows from oil tank 60 to the cylinder-piston units, hydraulic cylinder-piston units 63 are extended by rocking rocker 61 to drive oil into the hydraulic so that the slideway sections 5 will be extended for changing from the position of FIG. 9 to that of FIG. 10.

Figure 15:
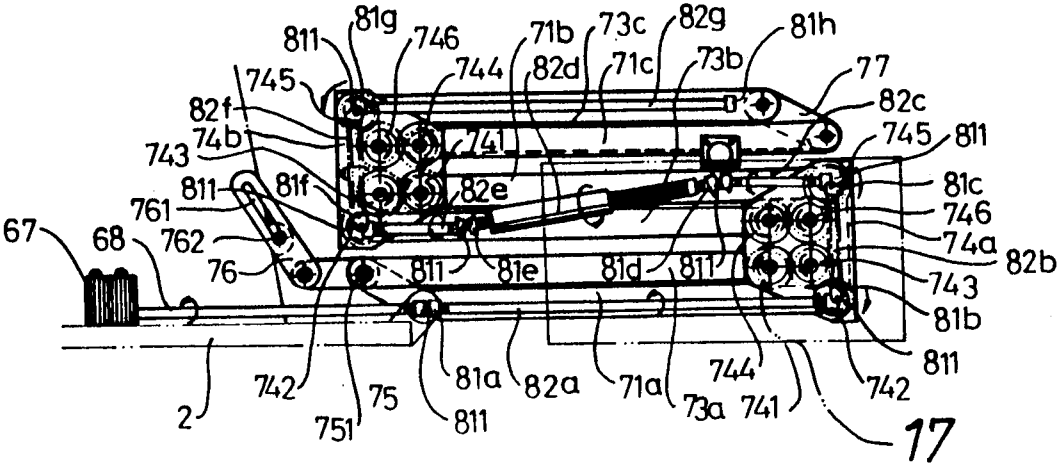
FIG. 15 is a view similar to FIG. 9 of a second embodiment of the slideway in accordance with this invention.
Figure 16:
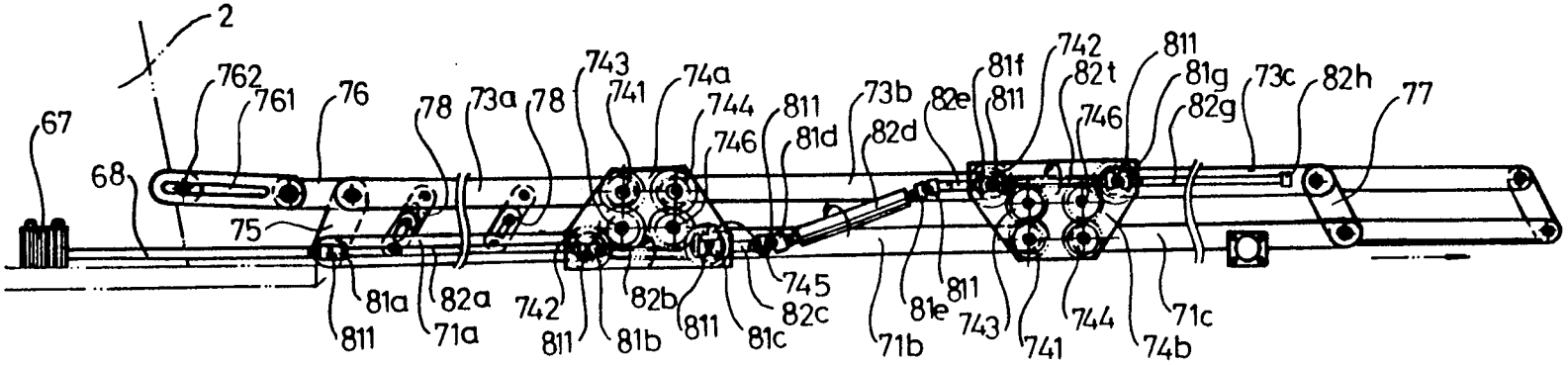
FIG. 16 is a view similar to FIG. 10 of a second embodiment of the escape slideway in accordance with this invention.

FIGS. 15 and 16 show another practical embodiment of the escape slideway of this invention. The slideway 7 is driven by the oil hydraulic motor 67 of hydraulic equipment 6. Oil hydraulic motor 67 drives a screw 68 to unfold and extend the folded slideway to a linear condition as shown in FIG. 15 to FIG. 16, for use as shown in FIGS. 7, 8.

Figure 17:
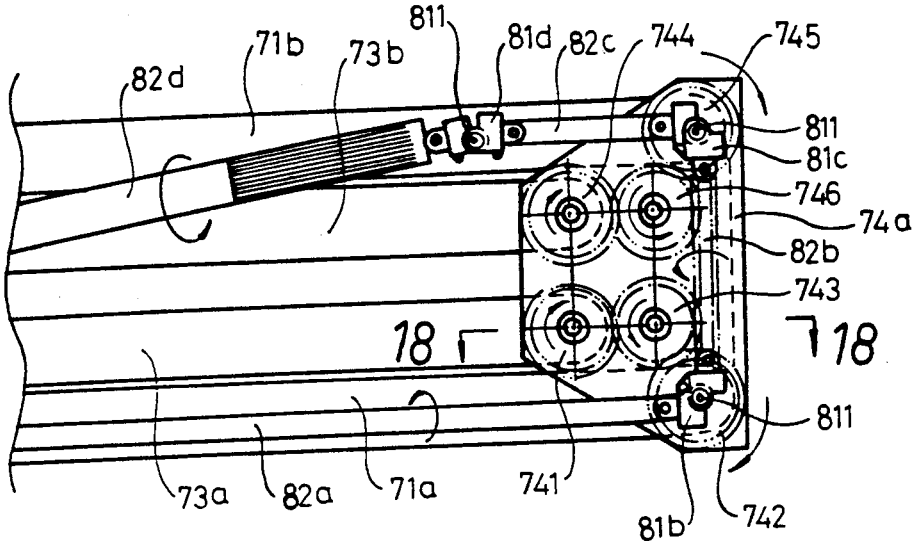
FIG. 17 is an enlarged detail view of the encircled part 17 in FIG. 15.
Figure 18:
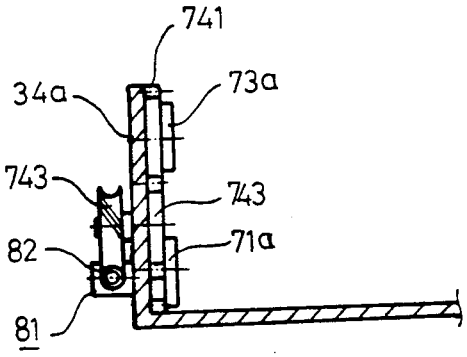
FIG. 18 is a cross-sectional view taken along line 18—18 of FIG. 17.

Referring to FIGS. 15, 16, the slideway sections 71 have three pitches. The slideway comprises first, second, and third slideway sections 71*a*, 71*b*, 71*c* similar to the sections of the first embodiment so that the sections are triple folded when they are not used. Each slideway section has a respective handrail 73*a*, 73*b*, 73*c*, similar to handrails 63*a*, 63*b* and 63*c* above. There are first connecting plate 74*a* between first and second slideway sections 71*a*, 71*b*, and a second connecting plate 74b between second and third slideway faces 71*b*, 71*c*. The inner ends of first slideway face 71*a* and first handrail 73*a* are pivotally connected to the ends of a starting plate 75 whose upper end has a pivot pin 751 to connect with first handrail 73*a*. The pin 751 also engages the outer end of a connecting plate 76 which pivotally engages at its inner end with a further plate having a long slot 761 slidably engaging a pin 762 which is fixed to swivel table 2. First slideway section 71*a* and the lower end of plate 75 each has a hole to engage with the pin 811 of a first universal joint 81*a* so that the pin forms a pivotal connection. First handrail 73*a* and first connecting plate 74*a* are pivotally connected similarly to the first embodiment and in addition a gear 74 is mounted on the same pivot pin. First slideway section 71*a* and first connecting plate 74*a* have round holes for engaging pin 811 of second universal joint 81*b*. The pin 811 joins with a gear 742 (see FIG. 17). Gears 741 and 742 are respectively engaged with a driving worm gear 743. Second handrail 73*b* and second slideway section 71*b* are pivotally connected with first connecting plate 74*a* and comprise gears 744, 745, a driving worm gear 746 (similar to gear 743), and a third universal joint 81*c* which have the same structure as the first handrail 73*a* and first slideway section 71*a* connected with first connecting plate 74*a*. Meanwhile, the worm driving gears 743, 746 are engaged with second universal shafts 82*b* having worm screw sections thereon. Also, second handrail 73*b* and slideway section 71*b* joining with second connecting plate 74*b*, and third handrail 73*c* and third slideway section 71*c* joining with second connecting plate 74*b* have the same structure comprising gears 741, 742, 744, 745, worm driving gears 743, 746, sixth universal joint 81*f*, and seventh universal joint 81*g*. The constituting elements of second connecting plate 74*b* and those of first connecting plate 74*a* are positioned 180° with respect to each other, i.e. inverted. The ends of third handrail 73*c* and third slideway section 71*c* are pivotally connected to an end plate 77 similarly to element 54*c* above.

Between each handrail 73 and slideway section 71, there are several connecting of links 78 constructed and used the same as links 57 described above.

Figure 19:
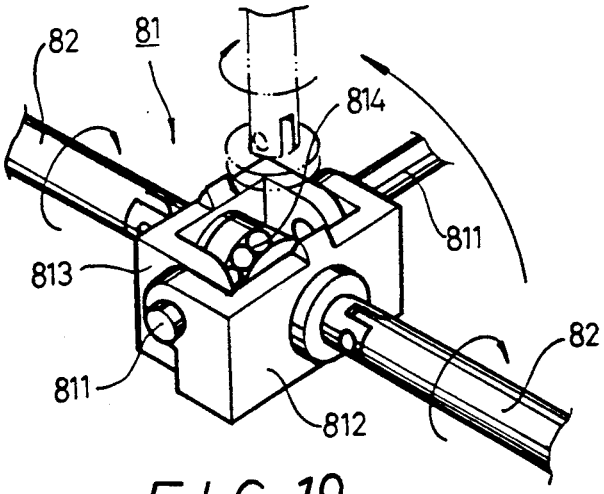
FIG. 19 is an enlarged perspective of a universal joint used in the second embodiment of the invention.
Figure 20:
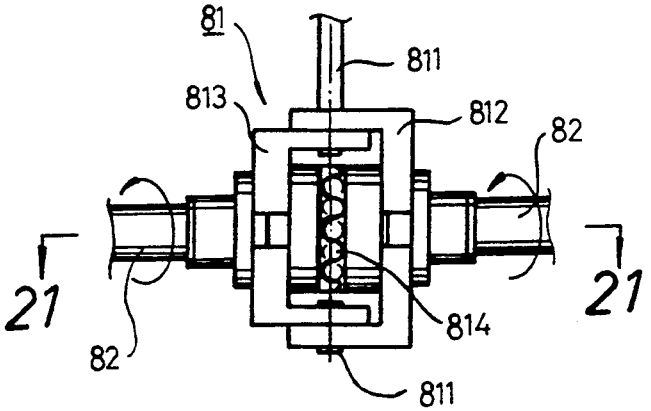
FIG. 20 is a top plan view of the universal joint of FIG. 19.
Figure 21:
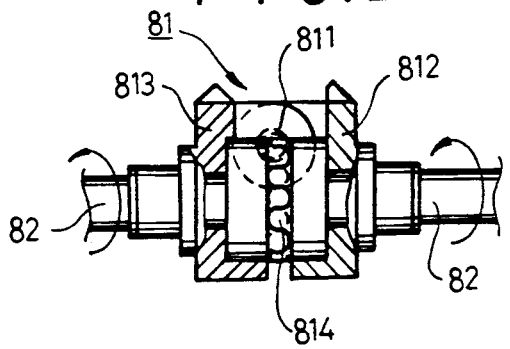
FIG. 21 is a cross-sectional view taken along line 21—21 of FIG. 20.
Figure 22:
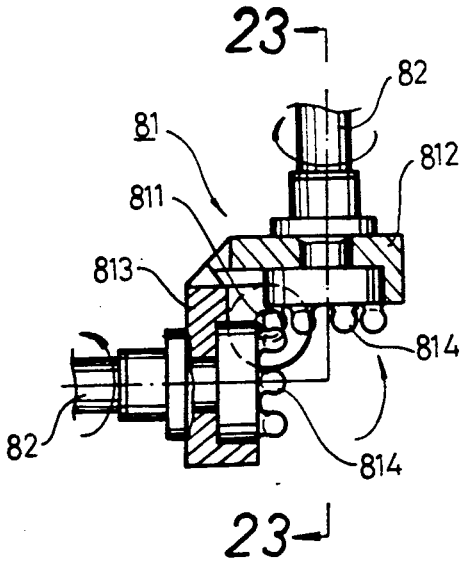
FIG. 22 is a view similar to FIG. 21 showing the U-joint turned 90.
Figure 23:
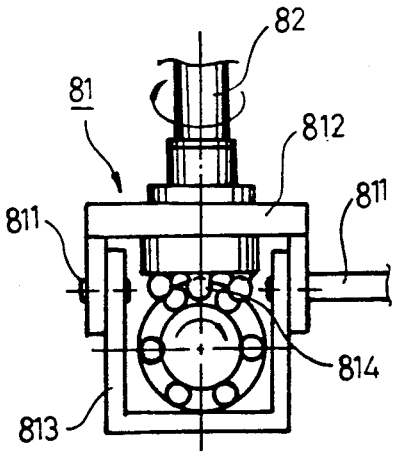
FIG. 23 is a cross-sectional view taken along line 23—23 of FIG. 22.

Referring to FIG. 19, universal joint 81 has two pins 811 pivotally connecting two base blocks 812, 813. The pins 811 have different lengths depending upon their use. The two base blocks 812, 813 of universal joint 81 are respectively connected with universal shafts 82. Referring to FIGS. 19-23, each universal joint 81 comprises two universal shafts 82 each having a spherical gear coupling member 814 engaging with the other, so that power can be transmitted through the U joints. When two universal shafts 82 form an angle between 0°-90°, the two spherical gear couplings 814 are still engaged to transmit power continuously.

Referring to FIG. 16, when oil hydraulic motor 67 rotates, the order of power transmission is as follows:

Shaft 68 drives first universal joint 81*a* to rotate first universal shaft 82*a*, second universal joint 81*b*, second universal shaft 82*b*, third universal joint 81*c*, third universal shaft 82*c*, fourth universal joint 81*d*, fourth universal shaft 82*d*, fifth universal joint 81*e*, fifth universal shaft 82*e*, sixth universal joint 81*f*, sixth universal shaft 82*f*, seventh universal joint 81*g*, and seventh universal shaft 82*g* whose outer end is supported in a shaft block 82*h*. Hence, oil hydraulic motor 67 rotatably drives all universal shafts 82 *a-g*. Second and sixth universal shaft 82*b*, 82*f* have worm screw threads thereon which are engaged with respective worm driving gears 743, 746 so that driving gears 743, 746 rotatably drive the respective gears 741, 742 of each handrail 73 and slideway section 71. Hence, the folded handrail and slideway sections can be extended from the folded position of FIG. 15 to the extended position of FIG. 16 to be used to cross to the top of a next building B as shown in FIG. 7, or reach earth as shown in FIG. 8 forming an escape slideway. The pitch and length of this slideway can be increased by adding connecting plates, drive shafts, U-joints and gears at every section so that the universal drive shafts can drive respective gears to transmit power for folding and extending the device.

The escape equipment provides users the ability to operate it rapidly in an emergency. The slideway can be extended to a safe place so that persons can protect their lives by escaping rapidly.

I claim:

1. An escape slideway comprising:

a base stand for mounting on a fixed structure and having an upper surface;

a ring gear mounted on said upper surface of said base stand and fixed thereto and having an upper surface and a lower surface;

a main shaft rotatably mounted on said base stand and extending upwardly and rotatably through said ring gear and having an upper end;

a swivel table connected non-rotatably to said upper end of said main shaft for rotation therewith and having an upper surface and a lower surface;

means engaging said upper surface of said ring gear and said lower surface of said swivel table for rotatably supporting said swivel table on said ring gear;

a driving gear rotatably mounted on said bottom surface of said swivel table engaging with said ring gear;

first oil hydraulic motor means on said swivel table operatively connected with said driving gear for rotating said driving gear and thereby rotating said swivel table relative to said fixed gear;

an oil tank mounted said upper surface of said swivel table;

control equipment means on said swivel table and connected to said oil tank and said first hydraulic motor means for selectively operating said first hydraulic motor means for controlling the rotation of said swivel table relative to said fixed gear;

a wire reel rotatable mounted on said upper surface of said swivel table;

second oil hydraulic motor drive means mounted on said swivel table and operatively connected to said wire reel for rotating said wire reel;

an articulated slideway having an inner end pivotally connected to said swivel table and an outer end remote from said swivel table;

a plurality of wire ropes each having an inner end connected to said reel and an outer end connected to said outer end of said slideway; and means for operating said second hydraulic motor means to rotate said reel selectively in opposite directions to adjust the position of said slideway relative to said base stand and so that rotation in one direction winds said wire ropes onto said reel to facilitate adjusting said slideway upwardly and rotation in the opposite direction unwinds said wire ropes from said reel to facilitate adjusting said slideway downwardly.

2. The escape slideway as claimed in claim 1 and further comprising:

roller support means mounted on said lower surface of said swivel table and engaging said lower surface of said ring gear for retaining said swivel table on said ring gear.

3. The escape slideway as claimed in claim 1 wherein said articulated slideway further comprises:

first, second, and third elongated slideway elements;

first, second, and third hand rails pivotally connected to said first, second and third slideway elements, respectively;

an inner end on said first slideway element pivotally connected to said swivel table;

an outer end on said first slideway element;

an inner end and an outer end on said first hand rail;

first hydraulic cylinder-piston means having the cylinder thereof pivotally connected to said swivel table and an outer end of the piston thereof pivotally connected adjacent to said inner end of said first hand rail;

first link means having an inner end pivotally and slidably connected to said swivel table and an outer end;

second link means having one end pivotally connected to said inner end of said first hand rail and another end pivotally connected to said outer end of said first link means;

a first connecting plate pivotally connected to said outer ends of said first slideway element and said first hand rail;

said second slideway element and said second hand rail each having one end pivotally connected to said first connecting plate;

a second connecting plate pivotally connected to the other end of said second slideway element;

a second hand rail link member having one end pivotally connecting to the other end of said second hand rail and the other end pivotally connected to said second connecting plate;

a second hydraulic cylinder-piston means having the cylinder thereof pivotally connected to said second connecting plate and an outer end of the piston thereof pivotally connected to said second hand rail and said second hand rail link member;

said third slideway element having one end thereof pivotally connected to said second connecting plate;

a third hand rail link member having one end pivotally connected to said second connecting plate and the other end thereof pivotally connected to one end of said third hand rail;

a third hydraulic cylinder-piston means having the cylinder thereof pivotally connected to said second connecting plate and an outer end of the piston thereof pivotally connected to said third hand rail link member and said third hand rail;

support links having ends thereof pivotally connected respectively to said first slideway element and first hand rail, said second slideway element and said second hand rail, and said third slideway element and said third hand rail; and means for operating said hydraulic cylinder-piston means so that operation of the respective pistons outwardly unfolds said slideway elements from said folded position to said extended position, and operation of the respective pistons inwardly folds said slideway elements and respective hand rails into said folded position.

4. The escape slideway as claimed in claim 3 wherein:

said support links each comprise two link elements each having a slot therein; and means for pivotally and slidably connecting said link elements together through said slots so that said support links have adjustable lengths.

5. The escape slideway as claimed in claim 1 wherein said articulated slideway further comprises:

first, second, and third elongated slideway elements;

first, second, and third hand rails pivotally connected to said first, second and third slideway elements, respectively;

an inner end on said first slideway element pivotally connected to said swivel table;

an outer end on said first slideway element;

an inner end and an outer end on said first hand rail;

first link means having an inner end pivotally and slidably connected to said swivel table and an outer end;

second link means having one end pivotally connected to said inner end of said first hand rail and another end pivotally connected to said outer end of said first link means;

a first connecting plate pivotally connected to said outer ends of said first slideway element and said first hand rail;

said second slideway element and said second hand rail each having one end pivotally connected to said first connecting plate;

a second connecting plate pivotally connected to the other end of each of said second slideway element and said second hand rail;

said third slideway element and said third hand rail each having one end thereof pivotally connected to said connecting plate;

support links having ends thereof pivotally connected respectively to said first slideway element and first hand rail, said second slideway element and said second hand rail, and said third slideway element and said third hand rail;

gear means operatively connected between said connecting plates and respective slideway elements and hand rails;

shaft means operatively connected to said gear means so that rotation of said shaft means rotates said gear means; and reversibly rotatable driving means for said shaft means so that rotation of said gear means in one direction unfolds said slideway elements and hand rails from said folded position to said extended position, and rotation of said gear means in the other direction folds said slideway elements and respective hand rails into said folded position.

6. The escape slideway as claimed in claim 3 and further comprising:

roller support means mounted on said lower surface of said swivel table and engaging said lower surface of said ring gear for retaining said swivel table on said ring gear.

7. The escape slideway as claimed in claim 5 and further comprising:

roller support means mounted on said lower surface of said swivel table and engaging said lower surface of said ring gear for retaining said swivel table on said ring gear.

8. The escape slideway as claimed in claim 5 wherein:

said support links each comprise two link elements each having a slot therein; and means for pivotally and slidably connecting said link elements together through said slots so that said support links have adjustable lengths.

* * * * *